US010208447B1

(12) United States Patent
May

(10) Patent No.: US 10,208,447 B1
(45) Date of Patent: Feb. 19, 2019

(54) APPARATUS AND METHOD FOR STABILIZING CRACKS AND JOINTS

(71) Applicant: Jason May, Edmonton (CA)

(72) Inventor: Jason May, Edmonton (CA)

( * ) Notice: Subject to any disclaimer, the term of this patent is extended or adjusted under 35 U.S.C. 154(b) by 0 days.

(21) Appl. No.: 15/832,094

(22) Filed: Dec. 5, 2017

(30) Foreign Application Priority Data

Oct. 24, 2017 (CA) ..... 2983543

(51) Int. Cl.

| | |
|---|---|
| ***E02D 37/00*** | (2006.01) |
| ***E04G 23/02*** | (2006.01) |
| ***E02D 29/02*** | (2006.01) |
| ***E02D 29/16*** | (2006.01) |
| *E02D 31/02* | (2006.01) |

(52) U.S. Cl.
CPC ..... *E02D 29/0266* (2013.01); *E02D 29/16* (2013.01); *E02D 37/00* (2013.01); *E04G 23/0203* (2013.01); *E02D 31/02* (2013.01)

(58) Field of Classification Search
CPC ..... E02D 37/00; E04G 23/02; E04G 23/0203; E04G 23/0211
See application file for complete search history.

(56) References Cited

U.S. PATENT DOCUMENTS

| | | | | |
|---|---|---|---|---|
| 1,905,405 | A | 4/1933 | Winslow | |
| 2,539,875 | A | 1/1951 | Van London | |
| 4,352,262 | A | 10/1982 | Edelmann et al. | |
| 5,063,006 | A | 11/1991 | Tahara | |
| 5,476,340 | A | 12/1995 | Contrasto | |
| 5,771,557 | A | 6/1998 | Contrasto | |
| 6,355,038 | B1 * | 3/2002 | Pisharodi | A61B 17/7043 411/538 |
| 6,517,277 | B2 | 2/2003 | Hu et al. | |
| 6,619,879 | B1 | 9/2003 | Scuero | |
| 7,223,046 | B1 | 5/2007 | Lim | |
| 7,334,963 | B2 | 2/2008 | Costa et al. | |
| 7,513,024 | B2 | 4/2009 | Keller | |
| 9,523,207 | B2 | 12/2016 | Weber | |
| 9,963,870 | B2 * | 5/2018 | Merlob | E04B 1/41 |
| 2007/0050963 | A1 * | 3/2007 | Keller | B23P 6/04 29/402.12 |
| 2014/0137503 | A1 | 5/2014 | Wheatley | |
| 2014/0248460 | A1 | 9/2014 | Taverne | |
| 2015/0068154 | A1 | 3/2015 | Merlob | |
| 2015/0300033 | A1 * | 10/2015 | Weber | E04G 23/0214 52/514 |

* cited by examiner

*Primary Examiner* — Frederick L Lagman
(74) *Attorney, Agent, or Firm* — Davis & Bujold PLLC; Michael J. Bujold

(57) ABSTRACT

An apparatus for stabilizing a crack or joint has an elongated plate with a cam gear end and a pin end. The cam gear end has a first aperture and the pin end has a second aperture. A cam gear is sized to fit within the first aperture of the elongated plated. The cam gear has a stud pin aperture positioned off a center point of the cam gear and a rotation point. A first stud pin is sized to pass through the stud pin aperture of the cam gear and a second stud pin is sized to pass through the second aperture. A locking mechanism for locking the cam gear in relation to the elongated plate is included.

12 Claims, 4 Drawing Sheets

APPARATUS AND METHOD FOR STABILIZING CRACKS AND JOINTS

FIELD OF THE DISCLOSURE

The present application relates generally to an apparatus and method for stabilizing cracks in foundations.

BACKGROUND

This section provides background information to facilitate a better understanding of the various aspects of the invention. It should be understood that the statements in this section of this document are to be read in this light, and not as admissions of prior art.

Concrete and asphalt are prone to suffering cracks over time due to a number of different factors. These include annual stresses produced by the freeze/thaw cycle, repetitive cyclic loading, and settling of the base over time. While it is possible to simply fill in a crack when it is formed, this does nothing to prevent the crack from expanding. Repair to the cracked surface, therefore, must be undertaken on a regular basis as the crack expands.

BRIEF SUMMARY

There is provided an apparatus for stabilizing a crack or joint. An elongated plate has a cam gear end and a pin end. The cam gear end has a first aperture and the pin end has a second aperture. A cam gear is sized to fit within the first aperture of the elongated plate. The cam gear has a stud pin aperture positioned off of a center point of the cam gear and a rotation point. A first stud pin is sized to pass through the stud pin aperture of the cam gear and a second stud pin is sized to pass through the second aperture. A locking mechanism is provided for locking the cam gear in relation to the elongated plate.

In one embodiment, the locking mechanism includes a notch on a circumference of the first aperture and at least one notch on a circumference of the cam gear. A locking key is provided that fits into the notch on the circumference of the first aperture and one of the at least one notches on the circumference of the cam gear. The locking key protrudes into both the notch on the circumference of the first aperture and one of the at least one notches on the circumference of the cam gear. The locking key locks the cam gear in relation to the elongated plate.

In one embodiment, the rotation point is a square aperture sized to accommodate a drive ratchet.

In one embodiment, the circumference of the cam gear has three notches. These notches are used during locking of the cam gear in relation to the elongated plate.

In one embodiment, the notch on the circumference of the first aperture is positioned 30 degrees from a central horizontal axis of the elongated plate.

There is also provided a method for stabilizing a crack or joint. A stabilizing device is provided. The stabilizing device has an elongated plate that has a cam gear end and a pin end. The cam gear end has a first aperture and the pin end has a second aperture. A cam gear is sized to fit within the first aperture of the elongated plate. The cam gear has a stud pin aperture positioned off a center point of the cam gear and a rotation point. A first stud pin is sized to pass through the stud pin aperture of the cam gear and a second stud pin sized to pass through the second aperture. A locking mechanism is provided for locking the cam gear in relation to the elongated plate is provided. A first hole and a second hole are drilled into a surface that has a crack or joint. The first hole and the second hole are spaced such that the first hole aligns with the stud pin aperture of the cam gear when the cam gear is placed within the first aperture and the second stud pin protrudes from the second hole. The first stud pin is then placed into the first hole and the second stud pin is placed into the second hole. Each of the first stud pin and the second stud pin should protrude from their respective holes. The elongated plate is then slid onto the first stud pin and the second stud pin such that the first stud pin passes through the first aperture and the second stud pin passes through the second aperture. The cam gear is slid onto the first stud pin such that the stud pin passes through the stud pin aperture and the cam gear rests within the first aperture of the elongated plate. The cam gear is rotated to cause the first stud pin and the second stud pin to move towards each other. The cam gear is then locked into position to hold the first stud pin and the second stud pin in position.

In one embodiment, a first step of excavating a crack is completed. By excavating the crack, the size of the crack can be determined and allow for proper positioning of the stabilizing device. It will also make clear the direction in which the crack has traveled.

In one embodiment, a final step of at least partially filling the excavated crack is completed. The crack may be filled with any suitable material known in the art such as epoxy, polymeric fillers, gravel, road crush, asphalt or concrete. The amount of fill to be used is determined by the user and may vary depending upon the type of material available, the location of the crack and other factors.

In one embodiment, the first hole and the second hole are drilled so that they are equally spaced on each side of the crack or joint.

In one embodiment, the first hole and the second hole are cleared of debris prior to the first stud pin and the second stud pin being placed within them.

In one embodiment, the first hole and the second hole are at least partially filled with an epoxy prior to the insertion of the first stud pin and the second stud pin.

In one embodiment, the rotation point of the cam gear is positioned on a central horizontal axis between the first stud pin and the second stud pin such that the rotation point is adjacent the crack or joint to be stabilized prior to rotation and locking of the cam gear.

In one embodiment, the first stud pin and the second stud pin are flush with a top of the elongated plate. This may be accomplished by drilling the first hole and the second hole to a specific depth or cutting the first stud pin and the second stud pin to a specific length depending upon the depth of the first hole and the second hole.

BRIEF DESCRIPTION OF THE DRAWINGS

These and other features will become more apparent from the following description in which references are made to the following drawings, in which numerical references denote like parts. The drawings are for the purpose of illustration only and are not intended to in any way limit the scope of the invention to the particular embodiments shown.

DETAILED DESCRIPTION OF THE PREFERRED EMBODIMENTS

Figure 1:
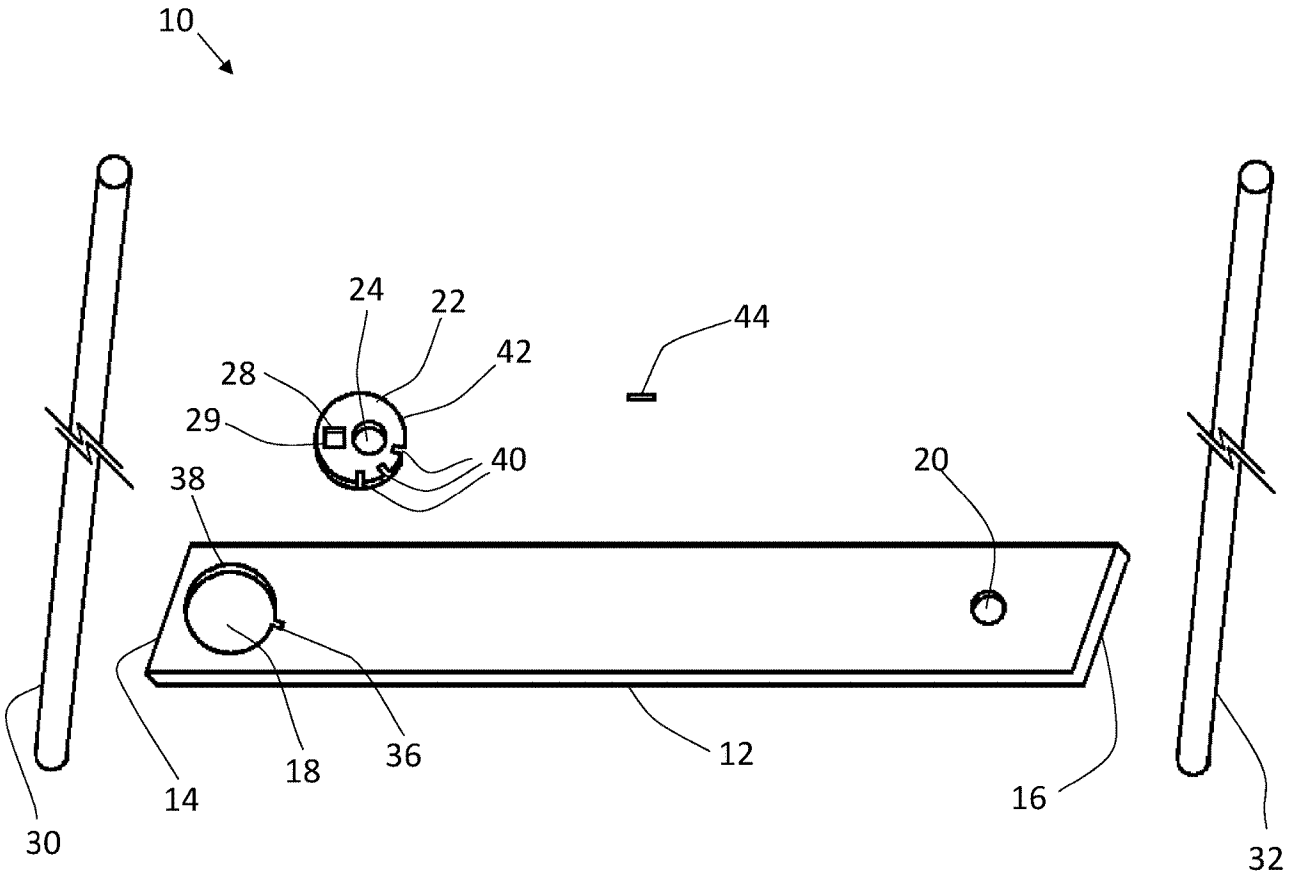
FIG. 1 is an exploded view of an apparatus for stabilizing a crack or joint.

An apparatus for stabilizing a crack or joint, generally identified by reference numeral 10, will now be described with reference to FIG. 1 through FIG. 6.

Figure 3:
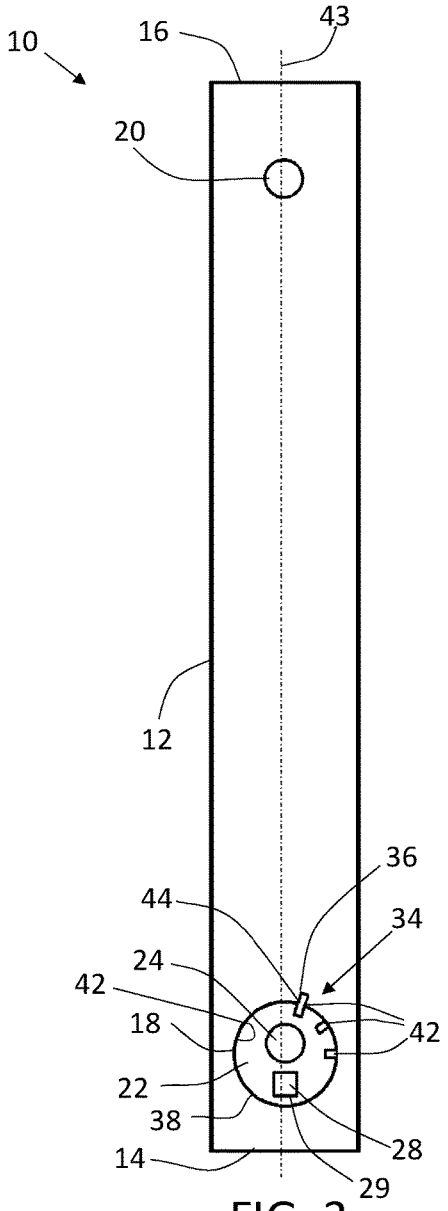
FIG. 3 is a top plan view of the elongated plate, cam gear and locking mechanism shown in FIG. 1
Figure 4:
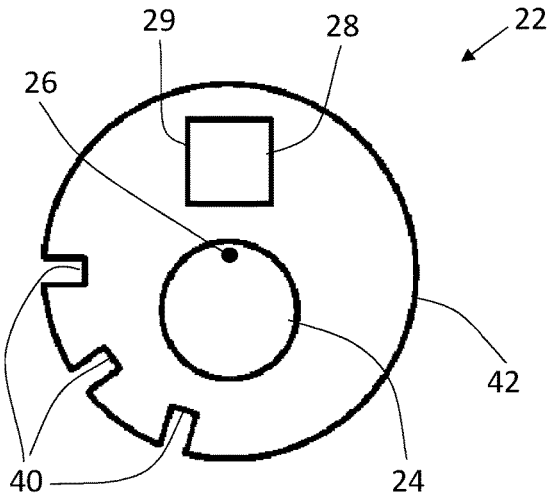
FIG. 4 is a top plan view of the cam gear of the apparatus shown in FIG. 1.
Figure 6:
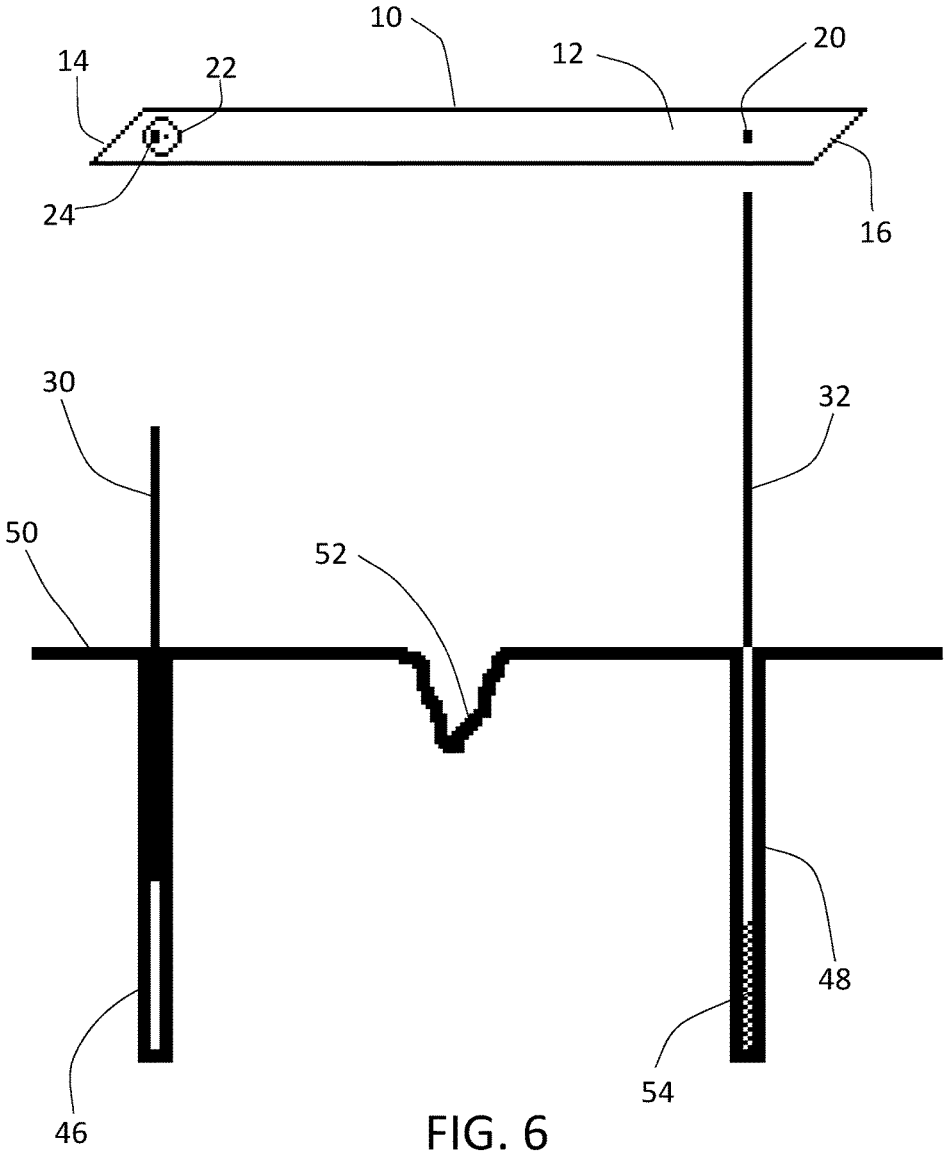
FIG. 6 is a side elevation view of the apparatus being installed.

Referring to FIG. 3, an apparatus 10 for stabilizing a crack or joint utilizes an elongated plate 12. Elongated plate 22 is preferably made of steel and has a flat profile. Elongated plate 12 has a cam gear end 14 and a pin end 16. Cam gear end 14 has a first aperture 18 and pin end 16 has a second aperture 20. A cam gear 22 is provided and sized to fit within first aperture 18 of elongated plate 12. It is preferable that cam gear 22 be made of steel. When on a flat surface, top of cam gear 22 may be flush, sunken or raised in relation to top of elongated plate 22. Referring to FIG. 4, cam gear 22 has a stud pin aperture 24 positioned off a center point 26 of cam gear 22 and a rotation point 28. In the embodiment shown, rotation point 28 is a square aperture 29 sized to accommodate a drive ratchet, not shown but known in the art. A person of skill will understand that rotation point 28 may be of a different shape to accommodate screw drivers or various types of ratchets. Rotation point 28 may be raised to allow for a wrench or other device to be used to cause rotation of cam gear 22. Referring to FIG. 6, a first stud pin 30 is sized to pass through stud pin aperture 24 of cam gear 22 and a second stud pin 32 is sized to pass through second aperture 20. Referring to FIG. 3, a locking mechanism 34 is provided for locking cam gear 22 in relation to elongated plate 12. In the embodiment shown, locking mechanism 34 has a notch 36 on a circumference 38 of first aperture 18 and at least one notch 40 on a circumference 42 of cam gear 22. In the embodiment shown, notch 36 is positioned on circumference 38 of first aperture 18 30 degrees from a central horizontal axis 43 of elongated plate 12. A person of skill will understand that the positioning of notch 36 may vary and will have an effect on how much pressure can be applied to first stud pin 30 and second stud pin 32. In the embodiment shown, three notches 40 are provided on circumference 42 of cam gear 22, however it will be understood that a more or fewer notches 40 may be provided. A locking key 44 is provided and sized to fit into notch 36 on circumference 38 of first aperture 18 and one of notches 40 on circumference 42 of cam gear 22. Locking key 44 protrudes into both notch 36 and one of notches 40 to lock cam gear 22 in relation to elongated plate 12.

Figure 5:
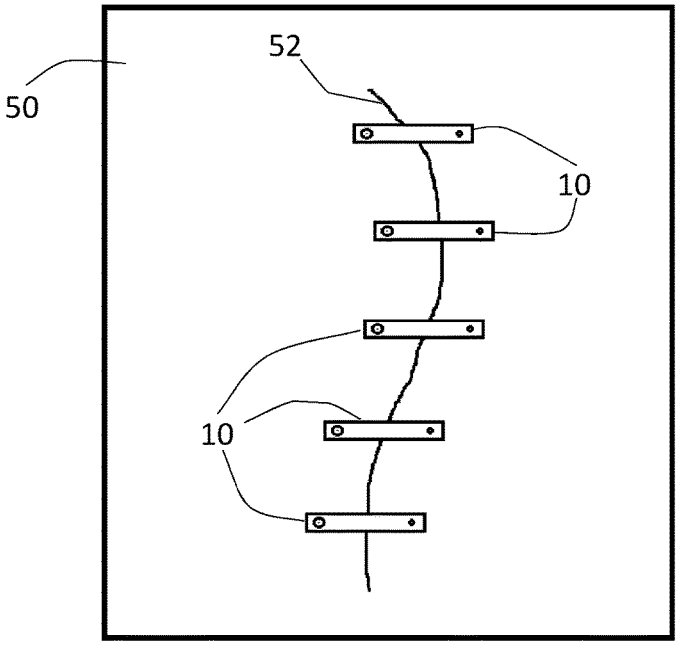
FIG. 5 is a top plan view of several apparatuses being used to stabilize a crack.

Referring to FIG. 6, prior to installing apparatus 10, it may be beneficial to excavate any cracks 52 being stabilized. Excavating the crack exposes the entire length of crack 52. Referring to FIG. 5, if a crack 52 is long, more than one apparatus 10 may be used at different spots along crack 52 to provide additional stability along the length of crack 52.

Figure 2:
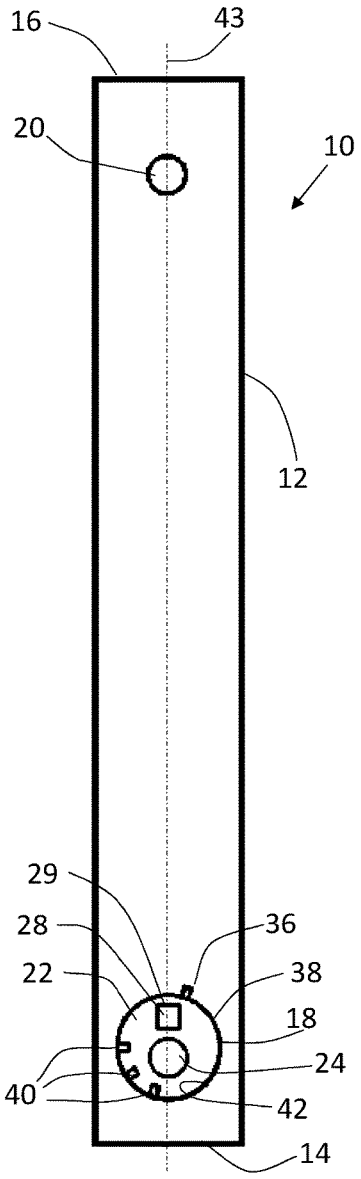
FIG. 2 is a top plan view of the elongated plate and cam gear of the apparatus shown in FIG. 1.

Referring to FIG. 6, when installing apparatus 10, a first hole 46 and a second hole 48 are drilled into a surface 50 having the crack 52 or joint to be stabilized. First hole 46 and second hole 48 are spaced such that the first hole 46 aligns with stud pin aperture 24 and second hole 48 aligns with second aperture 20. One way of accomplishing this is to utilize elongated plate 12 with cam gear 22 inserted as a guide to mark the proper locations of first hole 46 and second hole 48. Referring to FIG. 2, it is beneficial to have cam gear 22 rotated such that stud pin aperture 24 is positioned at as a great a distance as possible from crack 52. Referring to FIG. 1, this allows for maximum inward movement of first stud pin 30 during rotation of cam gear 22. Referring to FIG. 6, ideally, first hole 46 and second hole 48 are drilled such that they are equally spaced on each side of crack 52. It will be understood that first hole 46 and second hole 48 are not required to be equally spaced from crack 52 for apparatus 10 to stabilize crack 52. Once first hole 46 and second hole 48 have been drilled, debris may be cleaned out and first hole 46 and second hole 48 may be at least partially filled with epoxy 54 prior to first stud pin 30 and second stud pin 32 being inserted into first hole 46 and second hole 48, respectively. Cleaning debris out of first hole 46 and second hole 48 prevents debris from shifting over time within first hole 46 and second hole 48 and changing the pressure applied by first stud pin 30 and second stud pin 32. Epoxy 54 is used to keep first stud pin 30 and second stud pin 32 in first hole 46 and second hole 48, respectively. Epoxy may also be used to fill any voids with first hole 46 and second hole 48 to keep water from penetrating the holes and then freezing and causing further cracking due to the expansion of the water when it freezes. Cleaning out debris and the use of epoxy 54 are beneficial but not required for use of apparatus 10.

Once first stud pin 30 and second stud pin 32 have been inserted into first hole 46 and second hole 48, respectively, elongated plate 12 is slid onto first stud pin 30 and second stud pin 32. First stud pin 30 passes through first aperture 18 and second stud pin 32 passes through second aperture 20. Elongated plate 12 rests across crack 52 on surface 50. Cam gear 22 is slid onto first stud pin 30 such that first stud pin 30 passes through stud pin aperture 24, Cam gear 22 should rest on surface 50 within first aperture 18 of elongated plate 12. A person of skill will understand that elongated plate 12 and cam gear 22 may be slid into position at the same time or one after the other. The order in which elongated plate 12 and cam gear 22 are slid onto first stud pin 30 is unimportant. Once cam gear 22 and elongated plate 12 are in position, cam gear 22 is rotated to cause first stud pin 30 and second stud pin 32 to move towards each other. Referring to FIG. 2, in a preferred embodiment, rotation point 28 of cam gear 22 is positioned on central horizontal axis 43 between first stud pin 30 and second stud pin 32 such that rotation point 28 is adjacent crack 52 to be stabilized. Referring to FIG. 6, this orientation of cam gear 22 provides for the greatest amount of inward movement available to first stud pin 30 and second stud pin 32. It will be understood by a person skilled in the art that the positioning of rotation point prior to rotation of cam gear will affect the amount of movement permitted by first stud pin 30 and second stud pin 32. Rotation of cam gear 22 may occur through the utilization of rotation point 28. In the embodiment shown, a drive ratchet is inserted into square aperture 29 to rotate cam gear 22. A person of skill will understand that different tools may be used to rotate cam gear 22. Referring to FIG. 3, after rotation of cam gear 22, cam gear 22 is locked into position within elongated plate 12. This helps to prevent cam gear 22 from backing off over time and helps to keep the width of crack 52 from growing.

Referring to FIG. 6, following installation of apparatus 10, it is preferred that first stud pin 30 and second stud pin 32 be flush with top of elongated plate 12. This may be accomplished by drilling first hole 46 and second hole 48 to a specific depth or cutting first stud pin 30 and second stud pin 32 to a specific length depending upon the depth of first hole 46 and second hole 48. First stud pin 30 and second stud pin 32 may also be ground down following installation of apparatus 10.

Once cam gear 22 has been locked into positioned within elongated plate 12, crack 52 may be at least partially filled with suitable material. If epoxy 54 is used in first hole 46 and second hole 48, it should be allowed to cure completely before filling crack 52.

Any use herein of any terms describing an interaction between elements is not meant to limit the interaction to direct interaction between the subject elements, and may also include indirect interaction between the elements such as through secondary or intermediary structure unless specifically stated otherwise.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent that changes may be made to the illustrative embodiments, while falling within the scope of the invention. As such, the scope of the following claims should not be limited by the preferred embodiments set forth in the examples and drawings described above, but should be given the broadest interpretation consistent with the description as a whole.

What is claimed is:

1. An apparatus for stabilizing a crack or joint, comprising:

an elongated plate having a cam gear end and a pin end, and the cam gear end having a first aperture and the pin end having a second aperture;

a cam gear sized to fit within the first aperture of the elongated plate, and the cam gear having a stud pin aperture positioned off a center point of the cam gear and the cam gear further having a rotation point;

a first stud pin sized to pass through the stud pin aperture of the cam gear and a second stud pin sized to pass through the second aperture; and a locking mechanism for locking the cam gear in relation to the elongated plate, and the locking mechanism comprising:

a notch on a circumference of the first aperture;

at least one notch on a circumference of the cam gear;

a locking key sized to fit into the notch on the circumference of the first aperture and one of the at least one notch on the circumference of the cam gear such that the locking key protrudes into both the notch on the circumference of the first aperture and one of the at least one notch on the circumference of the cam gear so that the locking key locks the cam gear in relation to the elongated plate.

2. The apparatus for stabilizing a crack or joint of claim 1 wherein the rotation point is a square aperture sized to accommodate a drive ratchet.

3. The apparatus for stabilizing a crack or joint of claim 1 wherein there are three notches on the circumference of the cam gear.

4. The apparatus for stabilizing a crack or joint of claim 1 wherein the notch on the circumference of the first aperture is positioned 30 degrees from a central horizontal axis of the elongated plate.

5. A method for stabilizing a crack or joint, the method comprising the steps of:

providing an apparatus for stabilizing a crack or joint, the apparatus comprising:

an elongated plate having a cam gear end and a pin end, and the cam gear end having a first aperture and the pin end having a second aperture, a cam gear sized to fit within the first aperture of the elongated plate, the cam gear having a stud pin aperture positioned off a center point of the cam gear, and the cam gear further having a rotation point, a first stud pin sized to pass through the stud pin aperture of the cam gear and a second stud pin sized to pass through the second aperture, and a locking mechanism for locking the cam gear in relation to the elongated plate, and the locking mechanism comprising:

a notch on a circumference of the first aperture;

at least one notch on a circumference of the cam gear;

a locking key sized to fit into the notch on the circumference of the first aperture and one of the at least one notch on the circumference of the cam gear such that the locking key protrudes into both the notch on the circumference of the first aperture and one of the at least one notch on the circumference of the cam gear, so that the locking key locks the cam gear in relation to the elongated plate;

drilling a first hole and a second hole in a surface having the crack or joint, the first hole and the second hole being spaced such that the first hole aligns with the stud pin aperture of the cam gear when the cam gear is placed within the first aperture and the second hole aligns with the second aperture;

placing the first stud pin in the first hole and the second stud pin in the second hole such that the first stud pin protrudes from the first hole and the second stud pin protrudes from the second hole;

sliding the elongated plate onto the first stud pin and the second stud pin such that the first stud pin passes through the first aperture and the second stud pin passes through the second aperture;

sliding the cam gear onto the first stud pin such that the first stud pin passes through the stud pin aperture and the cam gear rests within the first aperture of the elongated plate;

rotating the cam gear to cause the first stud pin and the second stud pin to move towards each other; and locking the cam gear to lock the first stud pin and the second stud pin in position.

6. The method for stabilizing a crack or joint of claim 5 further comprising a first step of excavating a crack.

7. The method for stabilizing a crack or joint of claim 6 further comprising the final step of at least partially filling the excavated crack.

8. The method for stabilizing a crack or joint of claim 5 wherein the first hole and the second hole are equally spaced on each side of the crack or joint.

9. The method for stabilizing a crack or joint of claim 5 wherein the first hole and the second hole are cleared of debris.

10. The method for stabilizing a crack or joint of claim 5 wherein the first hole and the second hole are at least partially filled with an epoxy prior to the insertion of the first stud pin and the second stud pin.

11. The method for stabilizing a crack or joint of claim 5 wherein the rotation point of the cam gear is positioned on a central horizontal axis between the first stud pin and the second stud pin such that the rotation point is adjacent the crack or joint to be stabilized.

12. The method for stabilizing a crack or joint of claim 5, wherein the first stud pin and the second stud pin are flush with a top of the elongated plate.

* * * * *